US009725919B1

(12) United States Patent
Vanderpool et al.

(10) Patent No.: US 9,725,919 B1
(45) Date of Patent: Aug. 8, 2017

(54) HOT TUB COVER AND METHOD OF USING THE SAME

(71) Applicants: Richard Vanderpool, Newport Beach, CA (US); Oscar Cardenas, Murrieta, CA (US); Boyd Cargill, Murrieta, CA (US)

(72) Inventors: Richard Vanderpool, Newport Beach, CA (US); Oscar Cardenas, Murrieta, CA (US); Boyd Cargill, Murrieta, CA (US)

( * ) Notice: Subject to any disclaimer, the term of this patent is extended or adjusted under 35 U.S.C. 154(b) by 0 days.

(21) Appl. No.: 15/144,724

(22) Filed: May 2, 2016

(51) Int. Cl.
*E04H 4/00* (2006.01)
*E04H 4/10* (2006.01)
*A61H 33/00* (2006.01)

(52) U.S. Cl.
CPC ..... *E04H 4/108* (2013.01); *A61H 33/0087* (2013.01); *E04H 4/101* (2013.01)

(58) Field of Classification Search
CPC ..... E04H 4/101
USPC ..... 4/488, 498, 502
See application file for complete search history.

(56) References Cited

U.S. PATENT DOCUMENTS 2,897,668 A * 8/1959 Graham ..... E04H 9/10 109/1 S
4,246,663 A 1/1981 Aragona
5,745,932 A 5/1998 Barovetto
6,112,340 A * 9/2000 Ziebert ..... E04H 4/08 4/498
6,637,160 B2 * 10/2003 Brooks ..... E04B 1/0046 135/119
7,146,656 B2 * 12/2006 Hagan ..... E04H 4/084 4/498
8,683,621 B1 4/2014 Gustason

* cited by examiner

*Primary Examiner* — Lori Baker
(74) *Attorney, Agent, or Firm* — Eandi Fitzpatrick LLP

(57) ABSTRACT

A cover for a hot tub or spa is disclosed having a flat cross beam positioned across on a first axis of the tub, the flat cross beam having first and second ends, and being configured to support an interior cover, a curved joist disposed above the flat cross beam, and arranged in substantially the same plane as the cross beam, and pivotably connected to the flat cross beam at respective first and second ends, the curved joists being configured to support an exterior cover, a vertical connector engaged to the flat cross beam on one end and engaged to the curved joist on a second end, wherein upon applied motive force in a direction, the vertical connector is configured to collapse and flatten the exterior cover. A method of using the same is also disclosed.

15 Claims, 7 Drawing Sheets

HOT TUB COVER AND METHOD OF USING THE SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

This application relates generally to spa and hot tuber covers. More particularly, the invention relates to a domed hot tub cover configured to withstand heavy loads.

BACKGROUND

Hot tubs, also referred to herein as "spas" are devices in which water is kept at an elevated temperature, and benches or seats are provided for the users of the hot tub to sit. Typically, hot tubs are used for hydrotherapy, relaxation, or pleasure. Many have powerful jets for massage purposes, and as such, are extremely popular. Industry analyst IBIS World estimates international hot tub revenues will grow 7 percent this year, and have 13 percent annual growth through 2018. Much of this growth can be attributed to long felt need in climates that experience heavy snowfall.

Because hot tubs are typically installed outside of a home, a hot tub cover is required to insulate against heat loss, as well as to reduce evaporation, and the volatilization of pool chemicals.

Known hot tub covers that are currently in use are typically large, flat, rigid structures which contain foam insulation and are covered with a type of an artificial material designed to resemble leather, made from fabric coated with rubber or vinyl resin (e.g., naughahyde). The typical cover lays flat, and consists of two pieces which are hinged together such that the hot tub cover can be folded in half, and removed by the user, who must slide it from one side to the other, and off of the tub.

This ad hoc approach has many deficiencies and limitations, most critically that even light loads from snow and rainfall can collapse the cover, which in many cases, ruins the hot tub. Also, moisture from snow and rainfall together with condensation from below the hot tub cover, are gradually absorbed by the foam insulation such that the hot tub cover becomes saturated with water and thus, are extremely heavy to move. Current hot tub covers also present a flat surface on to which children may be tempted to climb on. When a hot tub cover has deteriorated with age, and the foam has become waterlogged and heavy, the weight of children on its flat surface may cause it to cave in, which presents a safety hazard to the children, as well as destruction of the hot tub cover.

There have been attempts to cure the aforementioned deficiencies. For example, U.S. Pat. No. 8,683,621 to Gustason describes a spa cover having a sealed bladder made with an elastic material with square tubes attached to the flexible bladder in parallel, and spans the spa width. It also contains a rain fly supported by fiberglass rods that arc from one end of a square tube to the other end of the same tube, and is anchored in the ends of the square support tubes which in turn, allows for the fiberglass rod to be compressed between the special end caps which create an arch that supports the rain fly.

Also, U.S. Pat. No. 5,745,932 to Berravrtto discloses a hot tub cover and enclosure which, when in a closed position, forms a waterproof cover for the hot tub and a sloping surface to shed snow and water while the hot tub is not in use. When in an open position, it provides privacy screening and wind protection.

Furthermore, U.S. Pat. No. 4,246,663 discloses a generally hemispherical dome designed to cover a hot tub and comprises a pair of successively smaller spherical shells, generally quadrantal in configuration, which are pivotally connected to a pin member vertically disposed through the superimposed apexes of the respective shells. A deck surrounding the perimeter of the hot tub provides basal support to the shells, as well as a bearing surface for roller wheels attached along the base of the smaller shell. Upon affixation of the larger shell to the deck, the smaller shell is rotated about the pin member through a range of superjacent positions relative to the fixed shell. A plurality of arcuate ribs form the framework of each shell. The ribs are adapted to support canopy material.

Problems with these past approaches are numerous in that they lack the structural integrity to support heavy loads, and are difficult to put on and take off. Furthermore, these past approaches are unduly complex, expensive to manufacture, and difficult to remove.

Accordingly, the present apparatus and method is directed towards overcoming these aforementioned problems, while setting forth a hot tub or spa cover that is durable and easily movable and usable.

SUMMARY OF THE INVENTION

The following summary of the invention is provided in order to provide a basic understanding of some aspects and features of the invention. This summary is not an extensive overview of the invention, and as such, it is not intended to particularly identify key or critical elements of the invention, or to delineate the scope of the invention. Its sole purpose is to present some concepts of the invention in a simplified form as a prelude to the more detailed description (s) that are presented below.

To achieve the forgoing and other aspects and in accordance with the purpose of the invention, a hot tub cover is presented.

Accordingly, it is an object of the present invention to provide a new and improved hot tub cover that is durable and can withstand very heavy loads.

Another object of the present invention is to provide a new and improved hot tub cover that is easily removable by a single user.

Another object of the present invention is to provide new and improved hot tub cover that is easy and inexpensive to construct A further object of the present invention is to provide new and improved hot tub that mitigates the number of steps a user must take in order remove the cover, and also to put the cover back on the tub.

In exemplary embodiments, a cover for a hot tub or spa is provide. The cover comprises a flat cross beam positioned across on a first axis of the tub, the flat cross beam having first and second ends, and being configured to support an interior cover; a curved joist disposed above the flat cross beam, and arranged in substantially the same plane as the cross beam, and pivotably connected to the flat cross beam at respective first and second ends, the curved joists being configured to support an exterior cover, a vertical connector engaged to the flat cross beam on one end and engaged to the curved joist on a second end, wherein upon applied motive force in a direction, the vertical connector is configured to collapse and flatten the exterior cover.

A method for covering a hot tub or spa is provided, the method comprising providing a flat cross beam positioned across on a first axis of the rigid frame and having first and second ends and configured to support an interior cover, providing a curved joist disposed above the flat cross beam, and arranged in substantially the same plane as the cross beams and pivotably connected to the flat cross beam at respective first and second ends, the curved joists configured to support an exterior cover, providing a vertical connector engaged the flat cross beam and engaged on a second end to the curved joist, applying a motive force in a direction on an x-axis such that the vertical connector is configured to collapse and flatten the exterior cover.

Other features, advantages, and aspects of the present invention will become more apparent and be more readily understood from the following detailed description, which should be read in conjunction with the accompanying drawings.

DETAILED DESCRIPTION OF THE INVENTION

Figure 1:
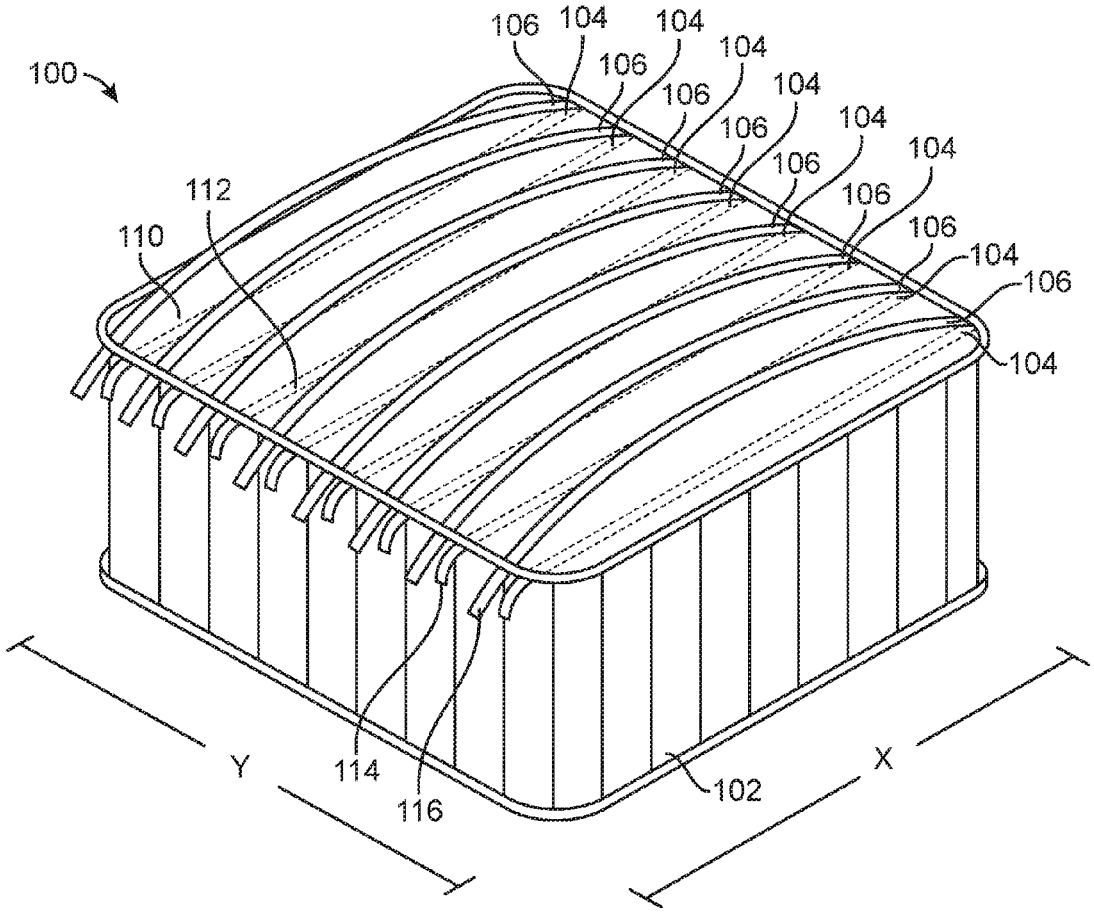
FIG. 1 perspective view of the hot tub cover in accordance with embodiments of the present invention.

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the," include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means, and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

With reference now to FIG. 1, a hot tub cover assembly mounted on a hot tub is shown generally at reference numeral 100. The cover 100 is shown in its extended position over the top of tub 102.

The cover comprises a plurality of flat cross beams 104 arranged in series, and a plurality of curved joists 106 arranged in a series, a plurality of vertical connectors arranged in series (shown in FIG. 2,), an interior cover 108 and an exterior cover 110. Each of the interior cover 108 and the exterior cover 110 are provided with a series of strap handles 114, and 116 which protrude from and down the side of the tub 102. The straps 114 and 116 give the user the ability to readily pull the cover off the tub so that it is compressed like an accordion, or in optional embodiments, rolled between the extended position of FIG. 1 and the retracted position of FIG. 6.

The hot tub shown in the drawings is an example of a popular wooden form with vertical wooden staves encircled by steel hoops. A tub may be about four feet deep and four to sixteen (or more) feet in diameter, may be a square, as shown herein, or a rectangle, as shown in other Figures. Because water temperature is typically maintained at 98°–105° F., the loss of heat from the uncovered water surface is substantial, and as such, an effective seal is paramount.

Figure 2:
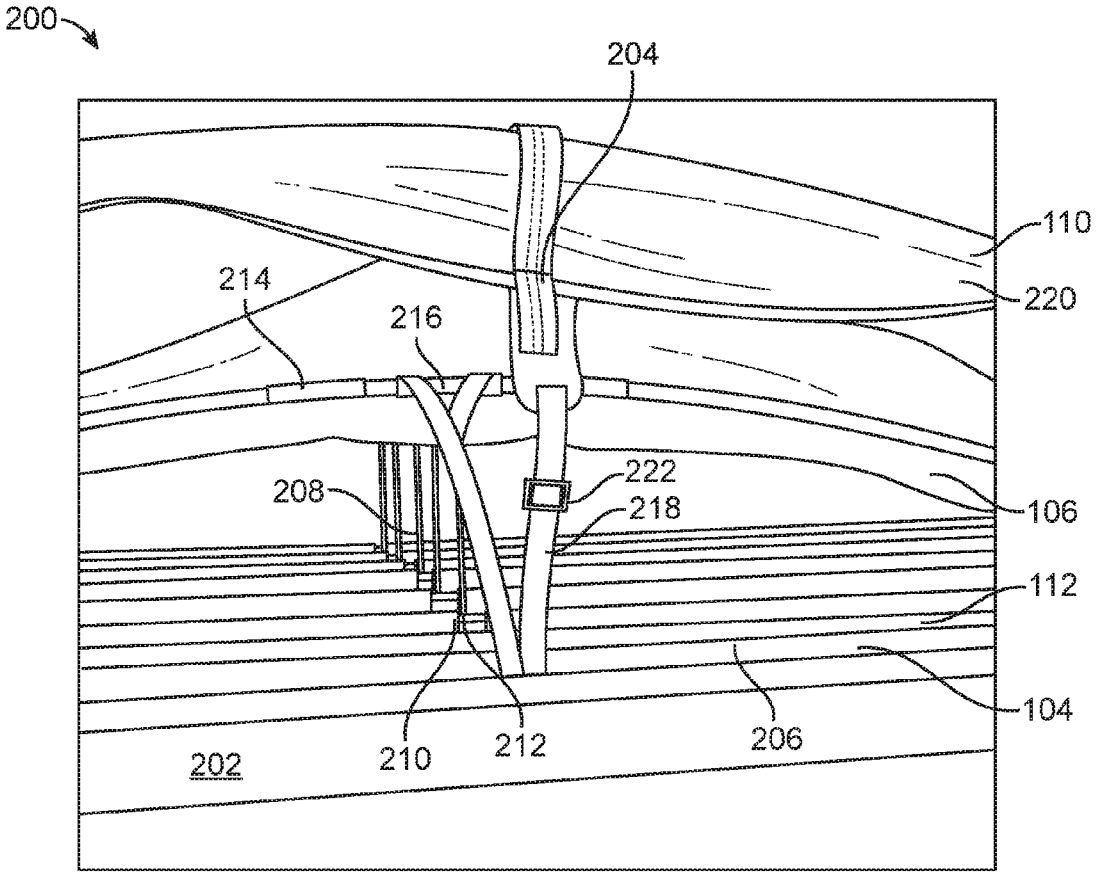
FIG. 2 is a perspective inside view of the cover in accordance with embodiments of the present invention.

The flat cross beams 104 is positioned on a first axis of the tub referred to herein as the x-axis, and are attached to or are partially disposed within the interior cover 112, as shown in FIG. 2. Curved joists 106 are disposed or positioned above the flat crossbeam 104 and are arranged in substantially the same plane as the cross beams 104. In other words, each of the flat cross beams together with the curved joists 106 form the shape of a half-moon, and thus an operation, form a dome structure.

The flat cross beams 104 and the curved joists 106 may be manufactured with polyvinyl chloride, commonly abbreviated PVC, a synthetic plastic polymer similar to polyethylene and polypropylene. The flat cross beams 104 may be rigid (sometimes abbreviated as RPVC) and the curved joists 106 may flexible, in some embodiments. In this way, using a motive force in a downward direction, using the straps, for example, the exterior cover 110 can collapse into a flat sheet and be rolled or compressed like an accordion for removal, to be discussed in more detail with relation to FIGS. 2-7. In optional embodiments, the cover need not be flattened at all, and is laterally compressed for removal.

In optional embodiments, fiberglass or other materials that exhibit flexibility, but are not so malleable where they are not reflexive, may be used. In some embodiments, liquid mixed metal stabilizers are used for PVC flexible applications. Liquid mixed metal stabilizer systems are primarily based on barium, zinc and calcium carboxylates. In general, liquid mixed metals like BaZn and CaZn require the addition of co-stabilizers and antioxidants. Organo-phosphites may be used to provide optimum performance.

uPVC, also known as rigid PVC, may also be used, and does not contain phthalates, since those are only added to flexible PVC, nor do they contain BPA. uPVC is known as having strong resistance against chemicals, sunlight, and oxidation from water, ad thus, may be employed in the present invention.

Referring now to FIG. 2, a front view of the cover is shown generally at 200. For purposes of orientation, like reference numerals are used to denote like parts. The exterior cover 110 is shown having a handle 204 on its y-axis. The interior cover 112 is shown resting on the hot tub top ridge 202. The flat crossbeam 104 is disposed within apertures of the interior cover 112. In this way the interior cover 112 comprises a plurality of jackets 206 that are dimensioned to house the flat cross beams 104 while serving the dual purpose of further connecting the cross beams 104 to the interior cover 112.

Still with reference to FIG. 2, vertical connectors 208 are shown herein. The vertical connector 208, on one end, is engaged to flat crossbeam 104. The jacket 206 has an opening which exposes the flat crossbeam 104. In this way, the vertical connector 208 can mate with the flat crossbeam 104 via aperture 212. In optional embodiments, the vertical connectors 208 comprises a screw/nut/bolt configuration for connection of elements. In optional embodiments, the vertical connector and crossbeam can be fitted using interference, press, or friction fits. Other optional embodiments may include clasps, ties, and the like.

The vertical connector 208, on its other end, is engaged to the curved joist 106. An exterior cover jacket 214 may be employed that, like the interior cover jackets 206, are dimensioned to house the curved joists 106, while serving the dual purpose of further connecting the cured joists 106 to the interior cover 112. The exterior cover jackets 214 in this embodiment cover less of the curve joists then the jackets that cover the flat cross beams 104. Again, like the flat cross beams 104, the vertical connector 208 can mate with the curved joist 106 via aperture 216. In optional embodiments, the vertical connectors 208 comprise a screw/nut/bolt configuration for connection pf elements, or can be fitted using interference, press, or friction fits. Other optional embodiments may include clasps, ties, and like.

Referring still to FIG. 2, a harness strap 218 is further provided. The harness strap 218 is removably engaged to the curved joist 106 and threaded around the flat crossbeam 104. Because each of the flat cross beams 104, curved joists 106, and vertical beams 208, comprise a plurality of flat cross beams, curved joists, and vertical beams in series down the axis of the tub, this threading action may continue down the structure from the first crossbeam and joist until the last crossbeam and joist, in series. The straps may be made of nylon, or like material, and comprise of adjustable slides 222. The adjustable slides operate to shorten or lengthen each of the strap portions, such that a user can alter the length of each of the straps and provide for a more secure fit, thus providing more rigidity to the structure. The adjustable slides 222 may comprise any adjustable buckle strap or analogous adjustable slide.

As can be seen in FIG. 2, the interior cover 110 forms a bond with the spa ridge to seal in heat. This seal is further strengthened based on the weight of the exterior cover 112.

In addition, a small hanging sealing flap 220 on the exterior cover 110 is used to provide additional closure between the two edges of the covers. In embodiments of the present invention, the covers are made of a made of a resilient, deformable material that allows the covers to conform to the different shapes of hot tubs, and therefore mate with tubs having a variety of different geometries or shapes. This provides an improved insulation barrier between the hot tub and cover 100.

As noted, the vertical connectors 106 may comprise male and female portions that may be press fit or fit by interference, such that they are easily connectable and separable, which allows easy and inexpensive replacement of parts. In optional embodiments, other means of coupling and decoupling such as Velcro®, clasps, buttons, threads, and the like may be used.

Figure 3:
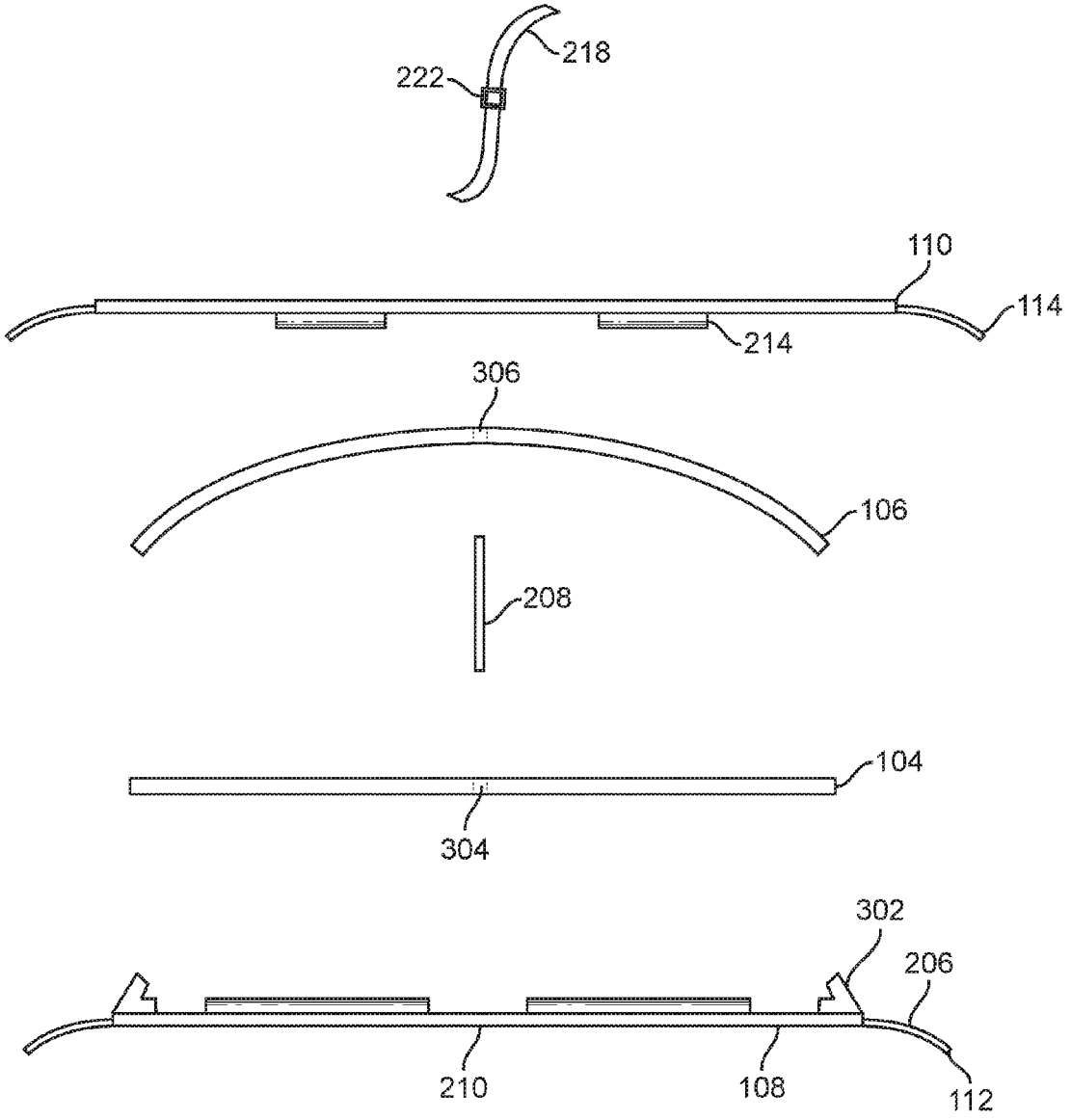
FIG. 3 is an exploded view of the cover in accordance with embodiments of the present invention.

Referring now to FIG. 3, an exploded perspective view of the hot tub cover is shown generally at reference 300. The cover comprises an interior cover 108 made of a durable vinyle coated fabrics. A cut out 210 is provided to allow a user or manufacturer to thread the flat cross beams 104 through the jackets 206 for additional stability. Straps 112 are provided on the interior cove to provide handles for a user to pull the cover off the tub, and/or compress the cover whilst pulling it off the tub. In optional embodiments, to be described in greater detail with relation to FIG. 6, a spindle mechanism may be provided approximate the tub and configured to apply a motive force in a direction to roll that cover into a spool as the mechanism revolves.

Vertical connectors 208 are removabley attached to the flat crossbeam 104 at connection point 304 in the curved joists at connection point 306. The vertical rods 308 are, in embodiments of the present invention, a lesser diameter than the flat cross beams 108 and curved joists 106. They may be adjustable in an up and down z-axis direction so as to increase the pitch of the dome. The adjustability may occur telescopically using a screw and wing nut, or other known method of raising and lowering a pole.

In operation, the vertical connectors 208 assist in carrying a heavy snow load on top of the exterior cover. In geographic locations in which heavy snow is not expected or anticipated, in optional embodiments of the present invention, the vertical connectors are not required. This is of course predicated upon the flexibility of the material of the curved joists. The vertical connectors 208 are made of a durable material such as vinyl coated fabrics. In this way they can be small and lightweight whilst still exhibiting be necessary strength to carry or withstand a heavy snow load.

The vertical connectors 208, in optional embodiments, have a rotational freedom of 180°, such that they can be vertical or also lie substantially flat. The rotational freedom may be achieved through the beam links 302, which are configured to connect the flat cross beams 108 and curved joists 106. These beam links may comprise v-shaped jackets which hold an end of the flat crossbeam 108 and an end of the joist 106. In optional embodiments, the ends of the flat crossbeam and curve choice may be movably connected via screw and wingnut for the like. In other embodiments, they may be fixed so as to disallow range of motion between the two.

The vertical connector can mate with the flat crossbeam 104 and the curved joist using interference, press, or friction fits. Other optional embodiments may include screws, rivets, clasps, ties, and like.

The vertical connector 208, on its other end, is engaged to the curved joist 106. Another or exterior cover jacket 214 may be employed that, like the interior cover jackets 206, are dimensioned to house the curved joists, while serving the dual purpose of further connecting the curved joists 106 to the interior cover 112. The exterior cover jackets 214 in this embodiment cover less of the curve joists than the jackets that cover the flat cross beams 104. Again, like the flat cross beams, the vertical connector can mate with the curved joist 106 via aperture 216. In optional embodiments, the vertical connectors 208 comprises a screw/nut/bolt configuration for connection of elements, or can be fitted using interference, press, or friction fits. Other optional embodiments may include clasps, ties, and like.

Still with reference to FIG. 3, the cover comprises an exterior cover 110 made of a durable vinyl coated fabrics. Jackets 214 are provided to allow a user or manufacturer to thread the curved joists through the jackets 214 for additional stability, and to connect the outer cover to the apparatus, as a whole, such the cover does not blow off during heavy winds. Straps 114 are provided on the exterior cove to provide handles for a user to pull the cover of tub, and/or compress the cover whilst pulling it off the tub. In operation, a user may pull down on the straps to flatten the curved joists 306 and pull the cover off by either rolling it or compressing it like an accordion. In optional embodiments, to be described in greater detail with relation to FIG. 6, a spindle mechanism may be provided approximate the tub and configured to apply a motive force in a direction to roll that cover into a spool as the mechanism revolves.

A harness strap 218 is further provided. The harness strap 218 is removably engaged to the curved joist 106 and threaded around the flat crossbeam 104. Because each of the flat cross beams 104 curved joists 106 and vertical beams 208 comprise a plurality of flat cross beams, curved joists, and vertical beams in series, the axis of the tub, this threading action, in some embodiments, may continue down the structure from the first crossbeam and joist until the last crossbeam and joist, in series. The adjustable slides 222 operate to shorten or lengthen each of the strap portions such that a user can alter the length of each of the straps. The adjustable slides 222 may comprise any adjustable buckle strap or analogous adjustable slide.

Figure 4:
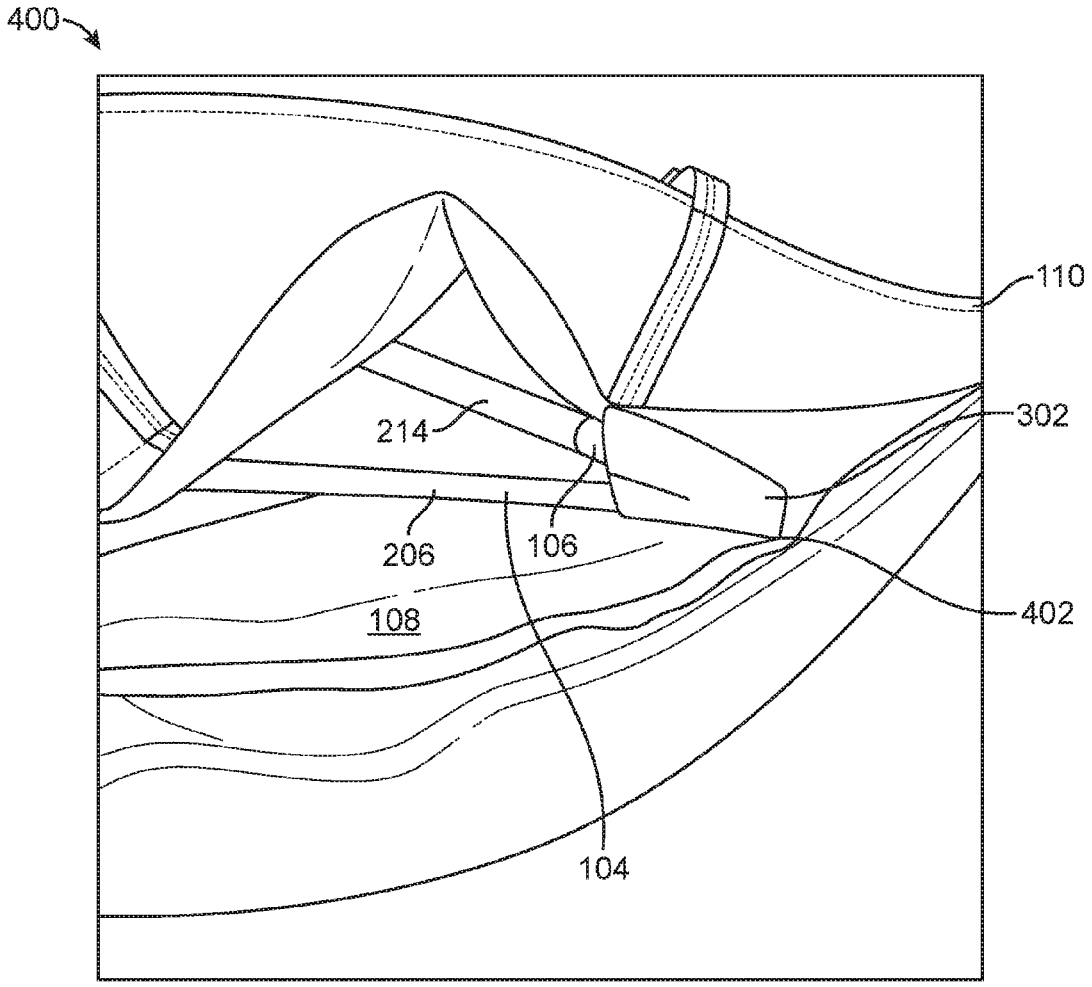
FIG. 4 is a front view of the cover in accordance with embodiments of the present invention.

Referring now to FIG. 4, more detailed perspective view of the beam link 302 are shown generally at reference numeral 400. For purposes of orientation, flat cross beams 104, curved joists 106, and jackets 206 and 214 are shown. The beam links 302 may be formed of the same material as the jackets 206 and 214, and the interior cover 108. The beam link 302 may be fixed to the interior cover at connection point 402. It can be fixed in any known manner such as by stitching, hardware such as screw and rivets, and the like. The beam links 302 are dimensions to firmly hold the flat crossbeam 104 and curved joist 106 via apertures or pockets in the beam link 302. In embodiments of the present invention, a further linkage within the beam link 302, such as a screw and bolt may be employed. However, in optional embodiments, the beam link pockets hold the beams in place. They may be further provided with an additional layer of material at the first edge, so as to increase strength and durability where the end of the flat crossbeam and curved joist meet, so as to ensure the beam link 302 does not tear under the pressure of a heavy load. In other optional embodiments, more durable and heavy duty stitching may be used to close an end of the beam link 302.

Figure 5:
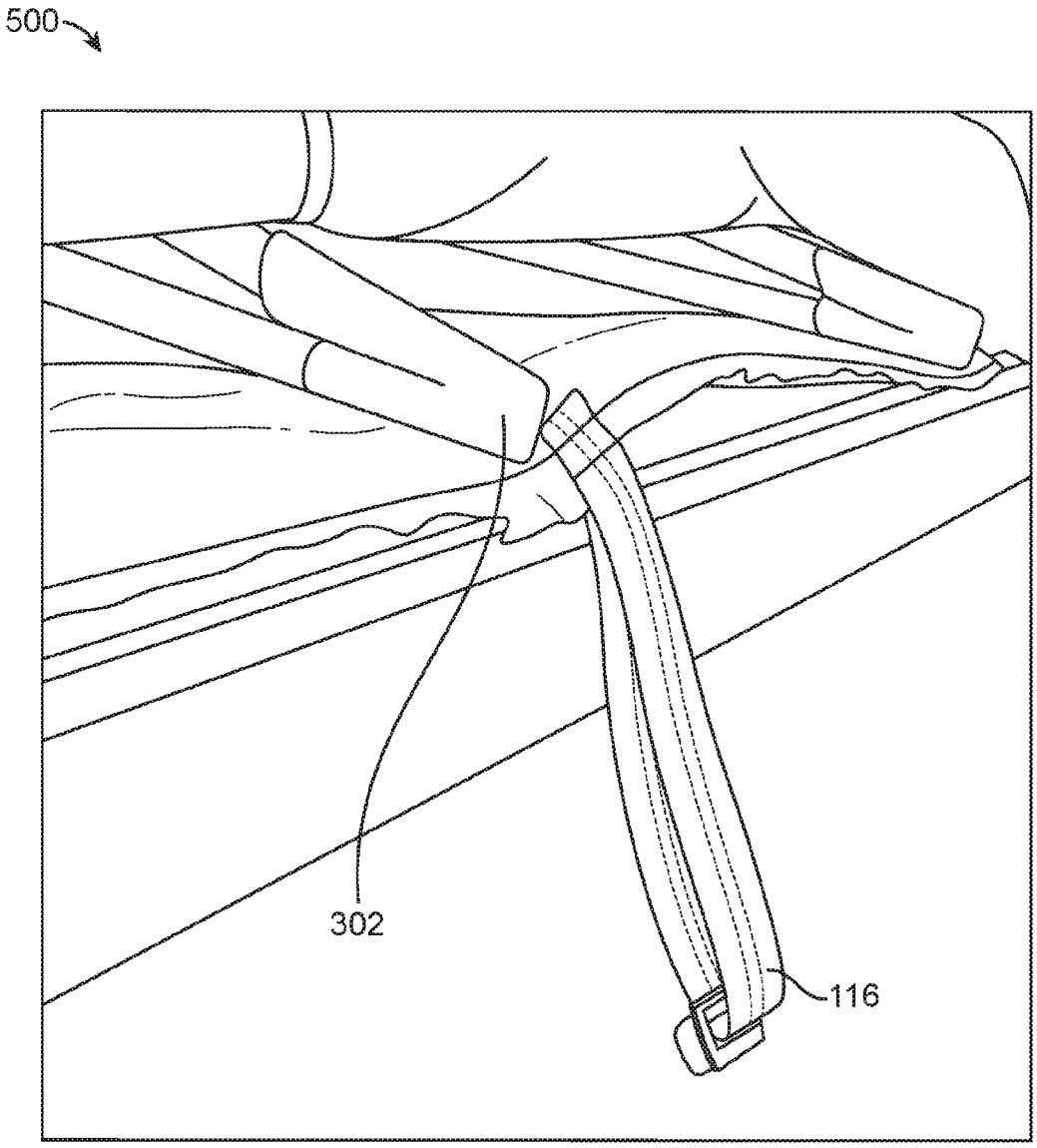
FIG. 5 is a perspective view of the interior of the cover in accordance with an embodiment of the present invention.

Referring now to FIG. 5, a more detailed perspective view of both the straps on the interior cover are shown at reference 500. As can be seen herein the strap 116 is fixed to the interior cover via stitching in area proximate the beam link 302. The straps of the of exterior cover may be situated similarly.

Figure 6:
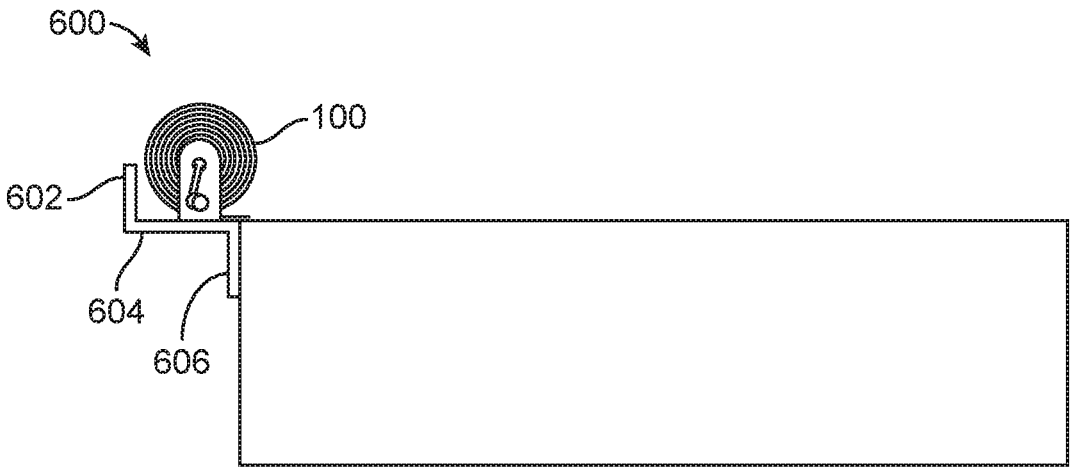
FIG. 6 is a side view of the cover accordance with exemplary embodiments of the present invention.

Referring to FIG. 6, a side view of a spindle role mechanism 600 is shown. A supporting rack 602 is attached to the tub, but may also be a stand-alone device proximate the tub 102. The cover 100 is showed in its rolled up or spindled state, but when extended, covers the tub in both x and y-axis directions. A roll support 604 is configured as an L-shaped bracket with brace 606 to attach to the tub. Support 604 is secured to the outer surface of a tub 102, and is also held by hoop.

In operation, as the spindle mechanism is rolled by a user, the curved joist is automatically flattened, because the vertical connectors fall away from the spindle while being rolled to form a flattened cover due to the force applied by the spindle as it is in ingress. The vertical connectors rotate downward to flatten as well, due to the degrees of revolutionary and rotational freedom of the vertical connectors. In this way, the cover is easily removable by a single user and has a smaller footprint than known designs.

Figure 7:
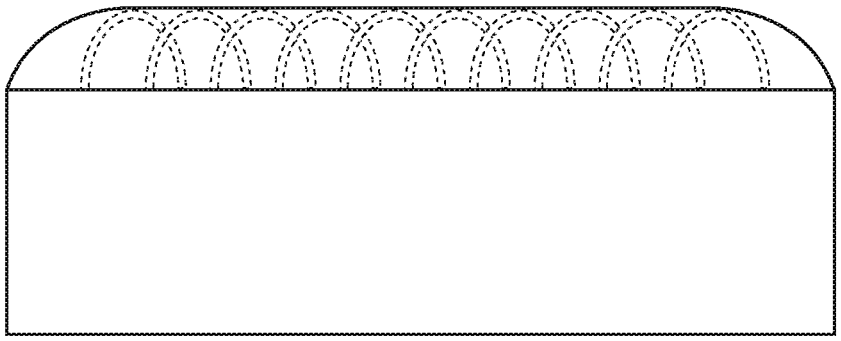
FIG. 7 is a side view of the cover in accordance with embodiments of the present invention.

Referring now to FIG. 7, a side view of the dome assembly is seen at 700 in its fully covered state.

Figure 8:
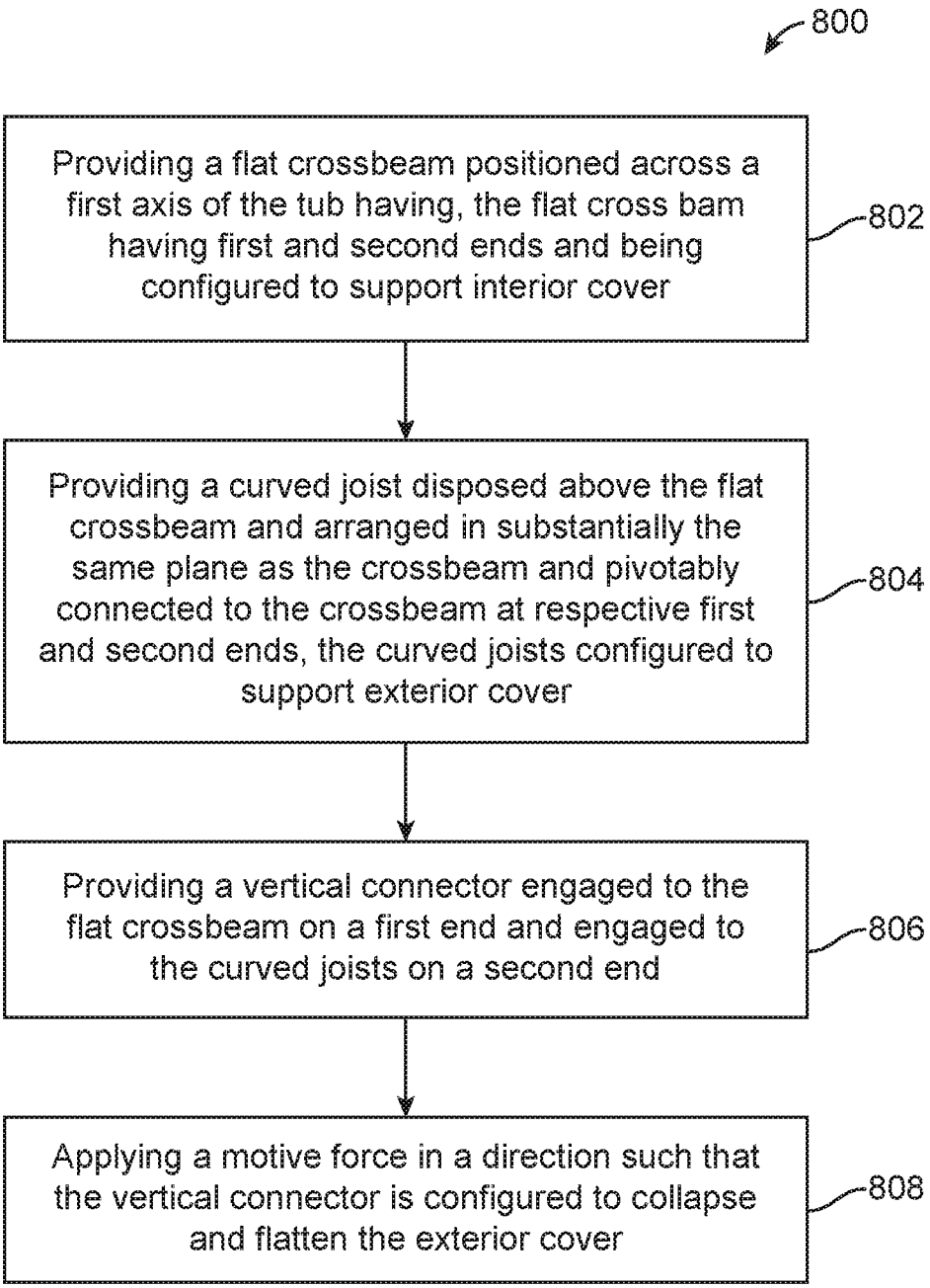
FIG. 8 is a flow chart describing a processor-based step-wise method in accordance with an embodiment of the present invention.

Referring now to FIG. 8, a flow chart is shown to better help illustrate a method for using a hot tub cover, generally, at 800. While the flowchart shows an exemplary step-by-step method, it is to be appreciated that a skilled artisan may rearrange or reorder the steps while maintaining like results.

At step 802, the invention provides a flat crossbeam position method for covering a hot tub or spa utilizing a rigid outer frame, the method comprises a flat cross beam positioned across on a first axis of the rigid frame and having first and second ends and configured to support an interior cover.

At step 804, the method provides a curved joist disposed above the flat cross beam, and arranged in substantially the same plane as the cross beams and pivotably connected to the flat cross beam at respective first and second ends, the curved joists configured to support an exterior cover.

At step 806, the method provides a vertical connector engaged to the flat cross beam and engaged on a second end to the curved joist.

At step 808, applying a motive force in a direction on an x-axis such that the vertical connector is configured to collapse and flatten the exterior cover, is provided by the user.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

Although specific features of various embodiments of the invention may be shown in some drawings and not in others, this is for convenience only. In accordance with the principles of the invention, the feature(s) of one drawing may be combined with any or all of the features in any of the other drawings. The words "including," "comprising," "having," and "with," as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

We claim:

1. A cover for a hot tub or spa, the cover comprising:

a flat cross beam positioned on a first axis of the tub, the flat cross beam having first and second ends, and being configured to support an interior cover;

a curved joist disposed above the flat cross beam, and arranged in substantially the same plane as the cross beam, and pivotably connected to the flat cross beam at respective first and second ends, the curved joists being configured to support an exterior cover;

a vertical connector engaged to the flat cross beam on a first end and engaged to the curved joist on a second end;

wherein upon applied motive force in a direction, the vertical connector is configured to collapse and flatten the exterior cover.

2. The cover of claim 1, further comprising:

a first set of strap handles attached to the interior cover on a longitudinal side; and a second set of strap handles attached to the exterior cover on a longitudinal side.

3. The cover of claim 1, wherein the pivotable connections between the flat cross beam and the curved joist is jacketed by extensions of the interior cover.

4. The cover of claim 1, wherein the joist is jacketed and fixed to the outer cover by extensions of the outer cover.

5. The cover of claim 1, wherein the flat cross beam, the curved joist, and vertical beams comprise a plurality of curved joists and a plurality of vertical connectors engaged to the other respectively arranged in series down the rigid frame.

6. The cover of claim 5, further comprising a harness strap connected to one of the plurality of flat cross beam, and extending to and engaged with the plurality of joists through the series of joists, and further connected to a second of the plurality of cross beams and the rigid frame.

7. The cover of claim 1, wherein the cross beams and joists are manufactured using synthetic plastic polymer.

8. The cover of claim 1, further comprising a spindle roll mechanism attached to the cover at one end and further proximate the hot tub, the spindle roll mechanism configured to apply a motive force in a direction to roll the cover into a spool as the mechanism revolves.

9. A method for covering a hot tub or spa utilizing a rigid outer frame, the method comprising:

providing a flat cross beam positioned across on a first axis of the rigid frame and having first and second ends and configured to support an interior cover;

providing a curved joist disposed above the flat cross beam, and arranged in substantially the same plane as the cross beams and pivotably connected to the flat cross beam at respective first and second ends, the curved joists configured to support an exterior cover;

providing a vertical connector engaged the flat cross beam and engaged on a second end to the curved joist;

applying a motive force in a direction on an x-axis such that the vertical connector is configured to collapse and flatten the exterior cover.

10. The method of claim 9, further comprising:

applying a force in a y-axis using a set of strap handles attached to the exterior cover on a longitudinal side.

11. The method of claim 9, wherein the pivotable connections between the flat cross beam and the curved joist is jacketed by extensions of the interior cover.

12. The method of claim 9, wherein the joist is jacketed and fixed to the outer cover by extensions of the outer cover.

13. The method of claim 9, wherein the flat cross beam, the curved joist, and vertical beams comprise a plurality of curved joists and a plurality of vertical connectors engaged to the other respectively arranged in series down the rigid frame.

14. The method of claim 13, further comprising a harness strap connected to one of the plurality of flat cross beam, and extending to and engaged with the plurality of joists through the series of joists, and further connected to a second of the plurality of cross beams and the rigid frame.

15. The cover of claim 1, wherein the cross beams and joists are manufactured using synthetic plastic polymer.

* * * * *